US007140220B2

(12) United States Patent
Caporusso

(10) Patent No.: US 7,140,220 B2
(45) Date of Patent: Nov. 28, 2006

(54) CURLING MACHINE PROVIDED WITH AN ADJUSTING DEVICE FOR EVENLY WINDING ELONGATED WORKPIECES INTO SPIRALS

(75) Inventor: Alessandro Caporusso, Piedimonte San Germano (IT)

(73) Assignee: CML International S.p.A., Piedimonte San Germano (IT)

( * ) Notice: Subject to any disclaimer, the term of this patent is extended or adjusted under 35 U.S.C. 154(b) by 253 days.

(21) Appl. No.: 10/715,862

(22) Filed: Nov. 19, 2003

(65) Prior Publication Data

US 2004/0129049 A1 Jul. 8, 2004

(30) Foreign Application Priority Data

Nov. 19, 2002 (IT) ..... RM2002A0580

(51) Int. Cl.
*B21C 47/00* (2006.01)
*B21D 37/04* (2006.01)

(52) U.S. Cl. ..... 72/147; 72/477; 29/560

(58) Field of Classification Search ..... 72/147, 72/146, 472, 148, 311, 133, 155; 29/560
See application file for complete search history.

(56) References Cited

U.S. PATENT DOCUMENTS

| | | | | |
|---|---|---|---|---|
| 2,801,669 | A * | 8/1957 | Lermont | 72/6.1 |
| 6,189,359 | B1 | 2/2001 | Caporusso et al. | |
| 6,823,579 | B1 * | 11/2004 | Veiga | 29/564.7 |

FOREIGN PATENT DOCUMENTS

| | | |
|---|---|---|
| DE | 27 06 533 | 1/1979 |
| DE | 27 06 533 A1 * | 1/1979 |
| EP | 0 992 297 | 4/2000 |
| IT | RM 2001 A 000552 | 3/2003 |

* cited by examiner

*Primary Examiner*—Lowell A. Larson
(74) *Attorney, Agent, or Firm*—Young & Thompson

(57) ABSTRACT

A curling machine provided with an adjusting device for evenly winding elongated workpieces into spirals, includes a machine frame sustaining a horizontal worktable; a vertical axis mandrel for a curling tool and provided with a counteracting device for acting on elongated workpieces passing through the worktable. The counteracting device is connected to an actuator in the form of an oleodynamic cylinder which is fixed on the worktable and provided with a rod carrying a tool holder in the free end of the rod, the vertical axis mandrel being removable from the worktable.

5 Claims, 4 Drawing Sheets

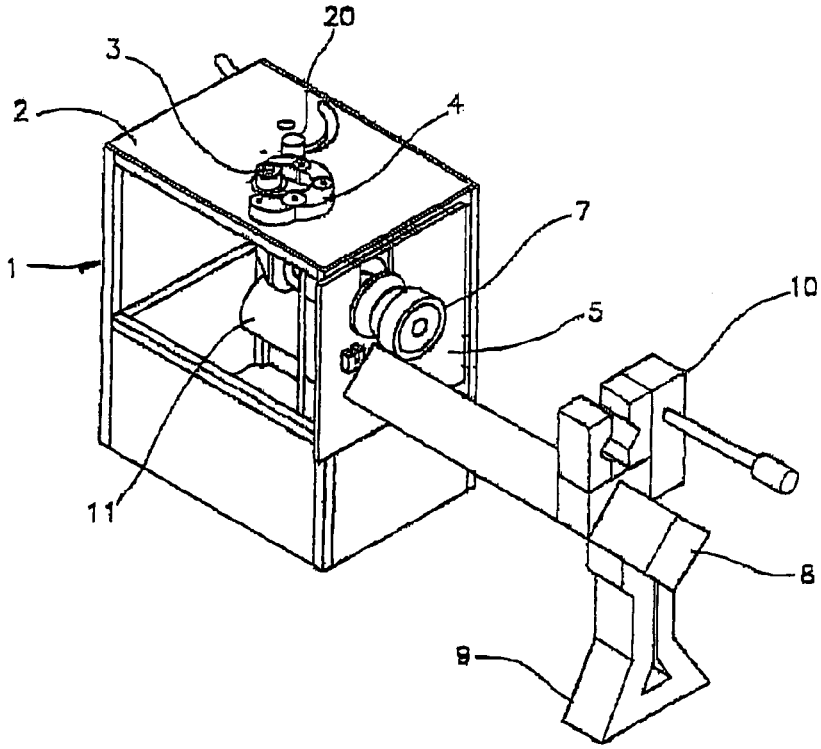
FIG. 1
PRIOR ART
FIG. 2
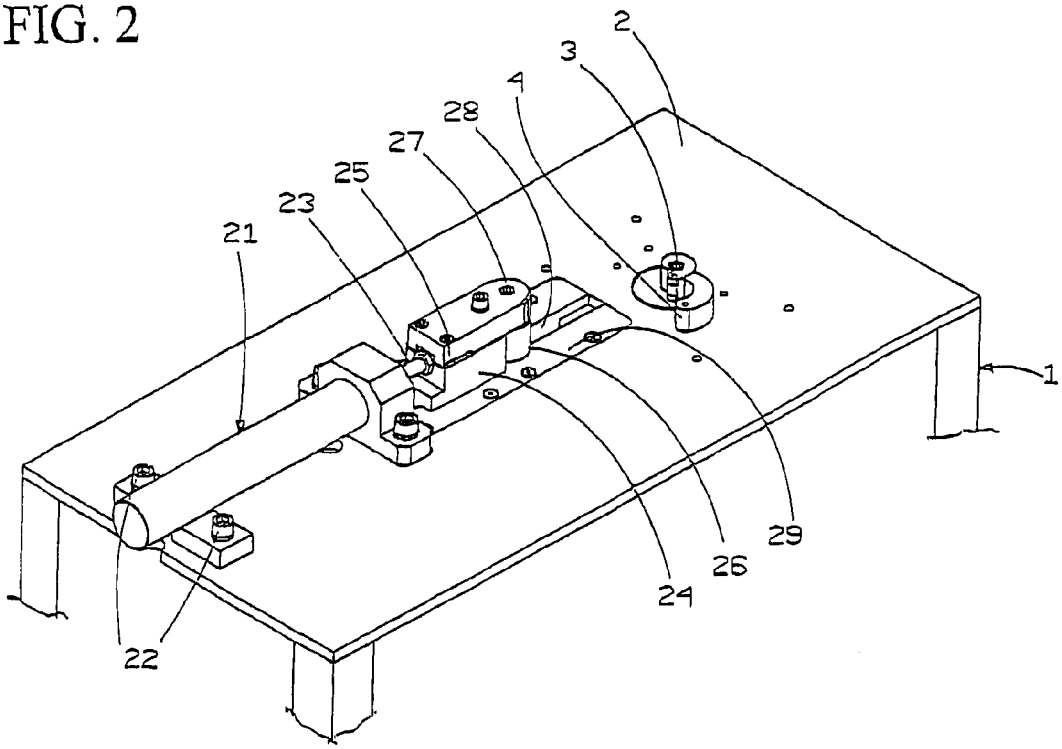

CURLING MACHINE PROVIDED WITH AN ADJUSTING DEVICE FOR EVENLY WINDING ELONGATED WORKPIECES INTO SPIRALS

BACKGROUND OF THE INVENTION

This invention relates to a curling machine provided with an adjusting device for winding evenly elongated workpieces into spirals.

The improvement can be particularly embodied to a machine having a vertical axis curling mandrel and a horizontal axis twisting mandrel that is yet disclosed in the Italian patent application No. RM2001A000552 by the same inventor. However, in the same way, the improvement could relate to only a curling machine.

Referring to FIG. 1 a combined machine for curling strips and twisting polygonal cross-section elongated workpieces, which is the subject-matter of the above mentioned patent application No. RM2001A000552 by the same inventor, is generally therein shown. This combined machine comprises a machine frame denoted as 1, sustaining an upper horizontal worktable 2. A vertical axis curling mandrel 3, designed to hold a curling tool 4, passes through the upper worktable 2. The curling tool 4 is comprised of a plurality of subsequent articulated links for bending a metal strip. The curling tool 4 is known from the Italian patent No. 1.302.352 by the same inventor. Further, on the same worktable 2 provision is made of a known lever-controlled supporting or counteracting element 20 for the metal strip in order to allow the metal strip to be buckled. A horizontal-axis chuck 7, which is provided with locking jaws for the one end of a workpiece to be twisted (such jaws are not shown in detail in the drawings, as known) is mounted in a not fixed way to a hollow twisting mandrel projecting from a front wall 5. A supporting bar 8, which is sustained by a pedestal 9 at its end, carries a vice 10 adapted to lock the other end of the generally polygonal cross-section workpiece to be twisted. An electric motor 11 through a suitable transmission, is mounted inside the frame 1 to move in turn both the curling mandrel and the twisting mandrel.

In operation, an elongated workpiece, such as a metal strip or other workpiece to be curled or bent into a spiral, is retained by the curling tool 4 which is connected to the vertical-axis mandrel. On the upper horizontal worktable 2 of the machine the supporting or counteracting element, in general a spring-charged pin (in case, carrying an idle roller) having a vertical axis movable along a slot of the horizontal worktable, is controlled by an operator through a hand-lever. The supporting or counteracting element acts as a sliding abutment for the elongated workpiece, which, otherwise, would only rotate around the bending mandrel, that retains the workpiece, and would not buckle.

The operation of the counteracting element and its function of co-operation with the curling mandrel for the deformation of the elongated workpiece are automatic. However, the force applied by the spring-charged pin onto the elongated workpiece, is not adjustable, since said force is merely produced by the lying and the shape of the slot along which the pin is moved. Further, such a force is susceptible to change in consequence of the progressive wear of the slot. Therefore, a machining reproducibility is not assured in the course of time.

SUMMARY OF THE INVENTION

An object of the present invention is to perform a curling operation on a workpiece in a continuous and uniform way, which is repeatable on the same workpiece and similar various workpieces.

Another object of the present invention is to adjust in either an automatic or half-automatic the force applied by the counteracting means of the elongated workpiece in a curling operation.

A further object is to achieve an energy saving by a suitable setting of the force applied by the counteracting means.

Therefore, the present invention provides a curling machine provided with an adjusting device for evenly winding elongated workpieces into spirals, comprising a machine frame sustaining a worktable; a mandrel usable for a curling operation and provided with counteracting means of elongated workpieces passing through said worktable, characterized in that said counteracting means comprises an actuator which is fixed on said worktable and provided with a rod carrying a tool holder in the free end of the rod, said mandrel being removable from the worktable.

The above mentioned invention has several advantages. In order to perform the curling, a roller with a vertical pin roller is mounted on the tool holder of the actuator. In case of an oleodynamic cylinder as an actuator, a desired pressure in the fluid is applied by an automatic or half-automatic setting so that a pin roller counteracts suitably the elongated workpiece that is being buckled.

Further, after removing the curling tool, a pipe bending die can be fit on the mandrel. Pipes can be bent by mounting a corresponding bending counter-die on the tool holder.

By completely removing the mandrel and fitting on the worktable a suitable equipment, such as a workpiece holder for both drawing or tapering, a counter-punch or other, the relevant mechanical operation can be performed, if a corresponding tool is mounted on the tool holder of the actuator.

It should be appreciated that the advantage offered by the present invention in general to make a simple curling machine universal, permitting a wide range of working. This produces an advantageous reduction of capital outlay for the user thereof.

BRIEF DESCRIPTION OF THE DRAWINGS

The present invention will be now described with reference to a preferred embodiment thereof and in its modifications, connection being made to the enclosed drawing, in which:

FIG. 1 shows a schematic perspective view of a known curling and twisting machine which is laterally open for clarity sake;

FIG. 2 shows a top fragmentary schematic perspective view of the worktable of the machine in FIG. 1, which is provided with an adjusting device according to the present invention;

DESCRIPTION OF THE PREFERRED EMBODIMENTS

Figure 3:
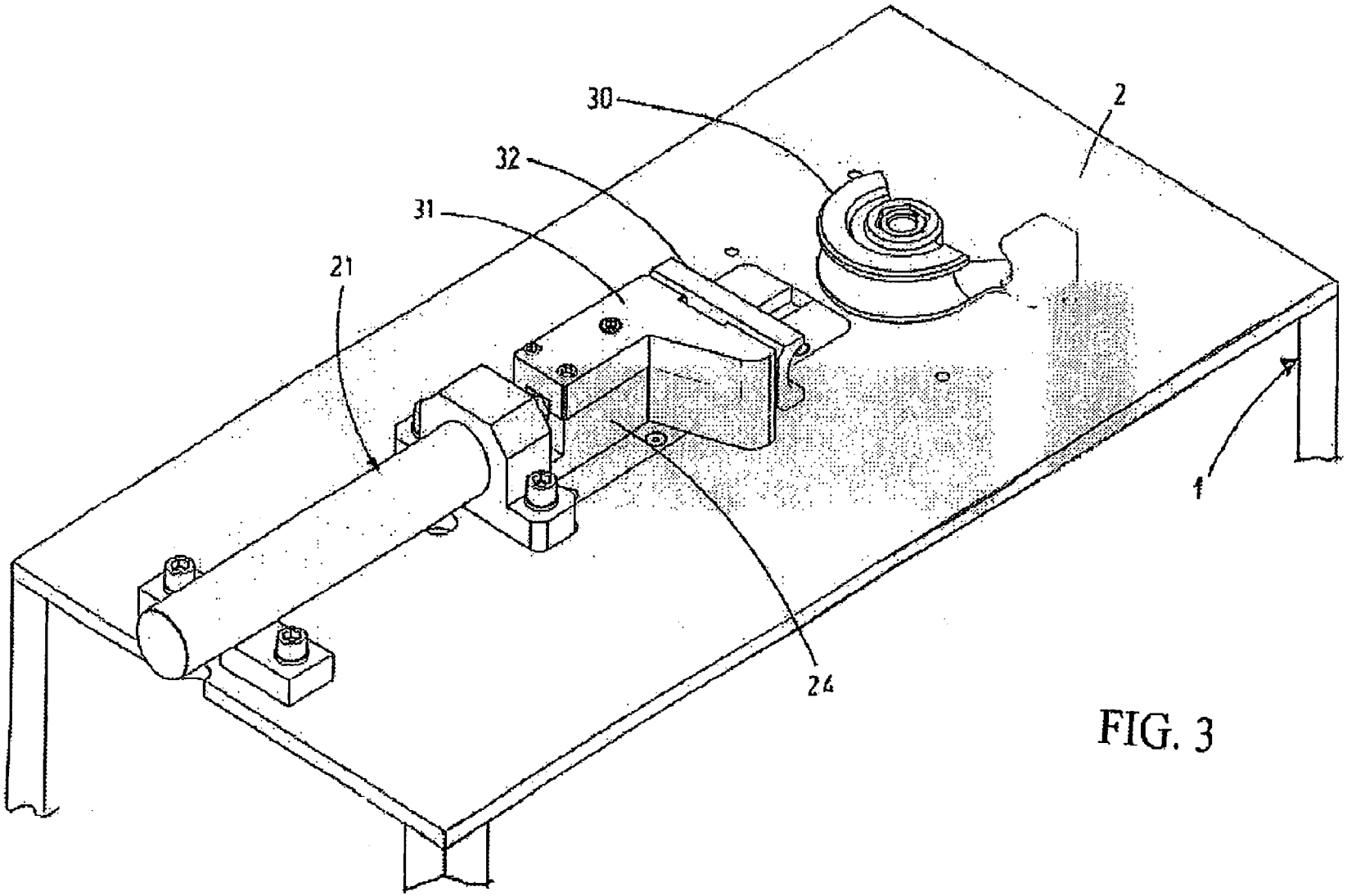
FIG. 3 shows a view similar to that in FIG. 2, in which the adjusting device is used for pipe bending operations.

With reference to FIG. 2, which is a perspective view of only the upper part or worktable 2 of a curling machine, e.g. that one in FIG. 1, an oleodynamic cylinder 21 is shown. It is not required that the worktable is the upper horizontal plane of the machine. It can be any plane, also not horizontal, of the machine.

The oleodynamic cylinder 21 according to the present invention acts as an actuator of a counteracting means for an elongated workpiece in a curling operation. Instead of an oleodynamic cylinder, equivalent actuators, e.g. pneumatic or electrical ones, can be used.

The oleodynamic cylinder 21 is fixed by bolts, generally denoted as 22, to the worktable 2, in parallel thereto. The cylinder 21 has a rod 23 having a tool holder 24 at its free end. Mounted to the tool holder 24 is a bracket 25 holding a roller 26 in its front end which is supported by a vertical axis pin 27. For a better stability the tool holder 24 is designed to slide in a groove 28 preferably made in a base 29 which is inserted on the worktable 2. In such a way an elongated workpiece, for example a metal strip (not shown), which is retained at one end thereof in a known way by a vertical axis mandrel 3 together with a curling tool 4, is in abutment with the roller 26. The roller 26 is submitted to a pressure set by the oleodynamic cylinder in order to control a suitable buckle of the elongated workpiece submitted to a curling operation.

In fact the oleodynamic cylinder 21 acts on the elongated workpiece submitted to a curling operation by contact, through the roller 26, which is connected to its rod 23. The counteracting force of the oleodynamic cylinder 21 applied by means of the rod 23 is set so that a optimal buckle of the elongated piece can be assured upon the rotation of the mandrel 3 and the curling tool 4.

When the curling tool 4 continues rotating upon the rotation of its mandrel, the rod 23 moves back as the cylinder chamber empties itself through a reduction of the volume of oil therein contained. This can be performed for example through a throttling valve or a variable displacement valve (not shown) which is provided on the discharge port of the cylinder itself. The behaviour of the valve can be automatic or half-automatic.

Alternatively other equivalent devices adapted to set the counteracting force can be used, depending on the kind of actuator. In any case, the counteracting force is primarily set depending on the increasing rate of the radius of the spiral being formed, on the shape of the cross-section and on the kind of material of the elongated workpiece. The setting of the counteracting force is not described in detail as it is within the reach of those skilled in the art.

The oleodynamic cylinder 21, or other equivalent actuator, can be advantageously used for other functions of the machine according to the present invention. Referring to FIGS. 3 to 6, which are perspective views similar to the FIG. 2, some ways of using the oleodynamic cylinder 21 are shown for example, which highly increase the range of use of the curling machine in which it is embodied.

In the modification in FIG. 3, mounted on the vertical axis mandrel 3 is a pipe bending die 30. On the oleodynamic cylinder 21 a shoe 31, holding a counter-die 32, is mounted on the tool holder 24. As known, in order to perform a bending operation of a pipe (not shown), the pipe is fit between the die 30 and the counter-die 32, which is suitably approached to the die by the oleodynamic cylinder 21. The position of the rod 23 is preset depending on the dimension of the die 30 and the counter-die 32, as well as on the material, and this position is conserved.

Figure 4:
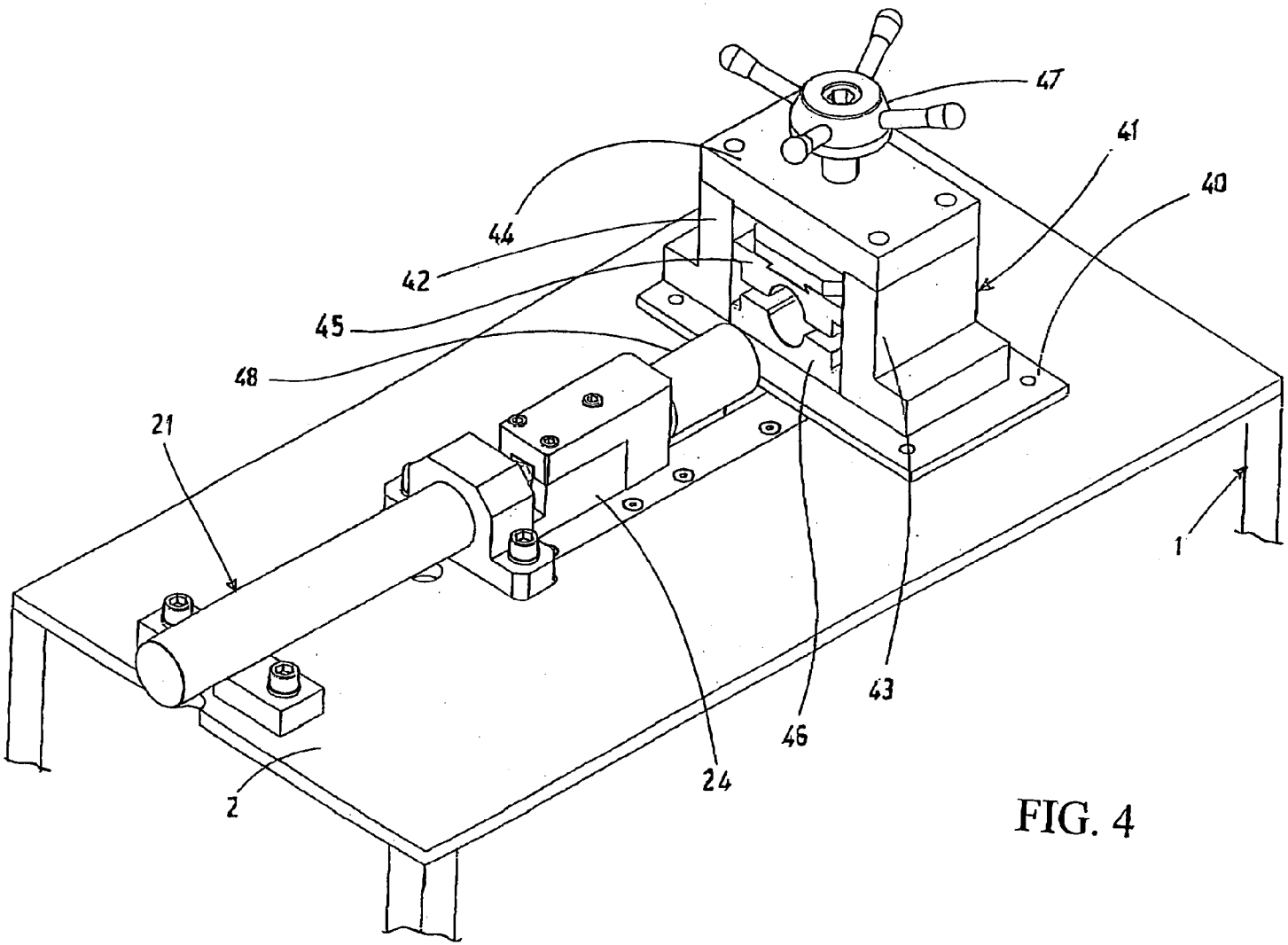
FIG. 4 shows a view similar to that in FIG. 2, in which the adjusting device is used for drawing or tapering operations.

In the modification of FIG. 4, the vertical axis mandrel 3 is removed. Instead of the mandrel 3, a base plate 40 is fixed to the worktable 2 by means of screws and not denoted by reference numeral. Mounted on the base plate 40 is a jaw-holder bridge 41 formed of a pair of uprights 42 and 43 and a cross member 44. In the bridge 41 workpiece-holder jaws 45, 46 can be set in their reciprocal distance by means of a handwheel 47 passing through the cross member 44 (or by equivalent means). On the bridge 41 there is mounted a workpiece (not shown) to be drawn or tapered under the action of a drawing tool or a tapering tool 48 which is mounted in turn on the tool-holder 24 of the oleodynamic cylinder 21.

Figure 5:
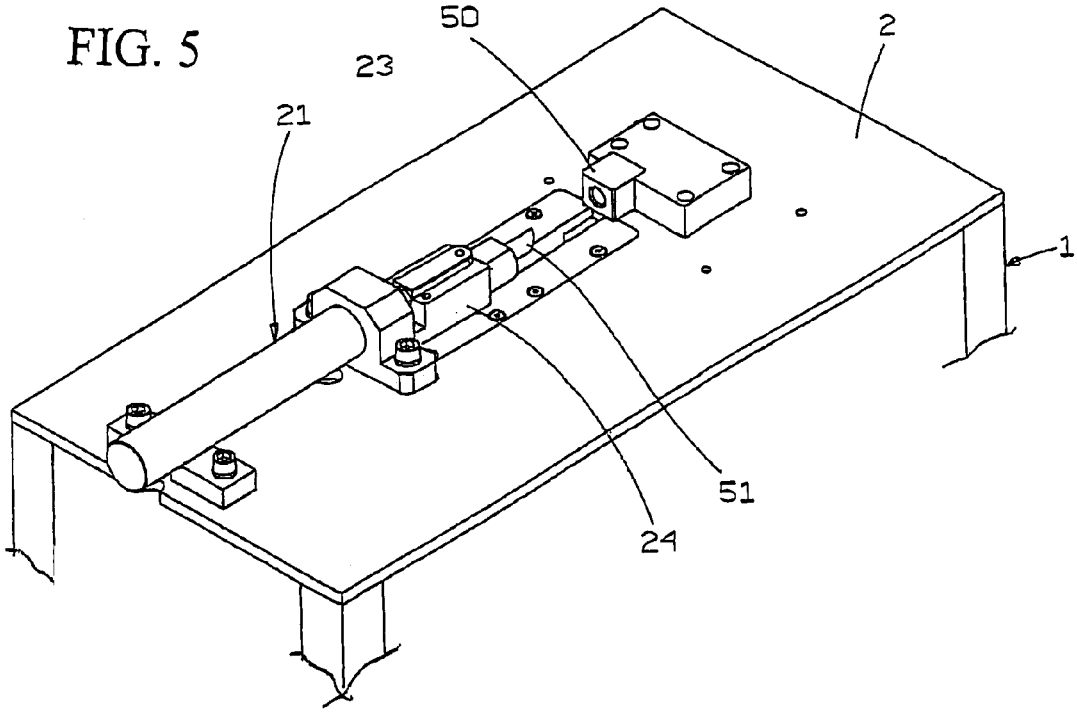
FIG. 5 shows a view similar to that in FIG. 2, in which the adjusting device is used for punching operations.

In order to demonstrate further capabilities of the oleodynamic cylinder of the present invention, with reference to FIG. 5, mounted on the upper horizontal worktable 2 is a counter-die for punching, denoted with 50. The tool-holder 24, carried by the free end of the rod 23, supports a punch 51.

Figure 6:
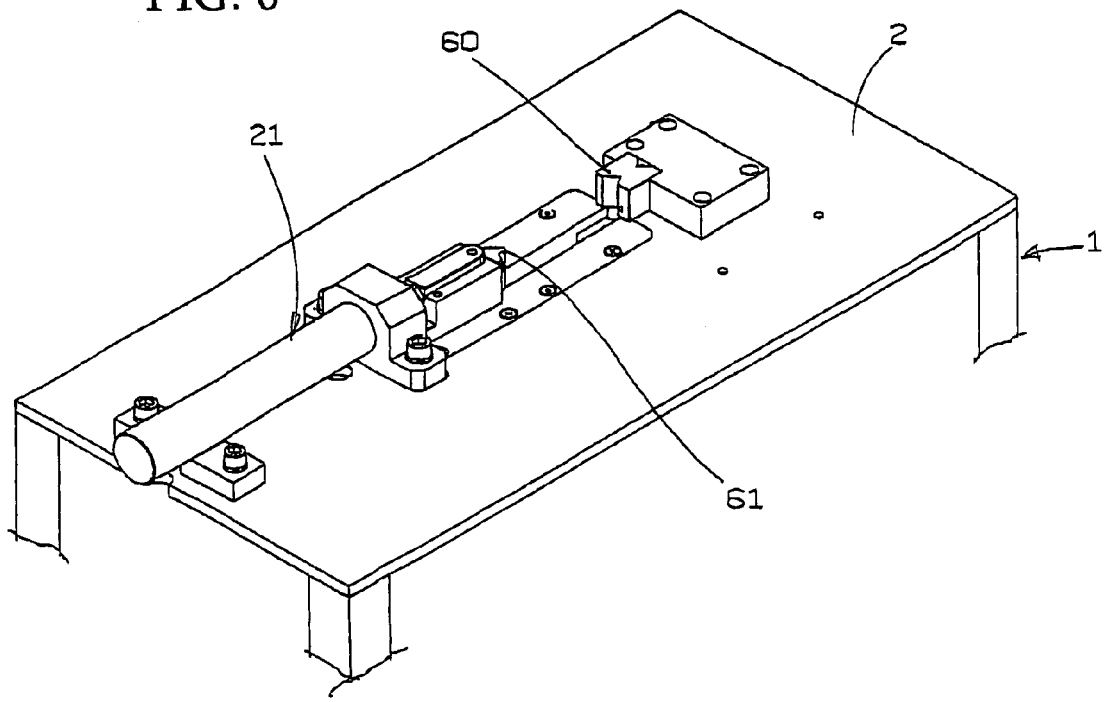
FIG. 6 shows a view similar to that in FIG. 2, in which the adjusting device is used for bending operations.

With reference to FIG. 6, a bending die 60 is mounted on the upper horizontal worktable 2, and the tool-holder 24 supports a bending die 61.

The oleodynamic cylinder 21 operates in known ways in the above mentioned working.

The present invention has been described with reference to its specific embodiment and modifications thereof, but it would be expressly understood that modifications, addition and/or omissions can be made without departing from the spirit of invention as defined in the enclosed claims.

The invention claimed is:

1. A curling machine provided with an adjusting device for evenly winding elongated workpieces into spirals, comprising:

a machine frame (1) sustaining a worktable (2);

a mandrel (3) usable for a curling operation; and counteracting means for acting on elongated workpieces, said counteracting means comprising an actuator which is immovably fixed on said worktable (2) and provided with a rod (23) carrying a tool holder (24) in the free end of the rod, said mandrel (3) being removable from the worktable (2).

2. Machine according to claim 1, characterized in that said tool holder (24), which is carried by the free end of said actuator rod (23), supports an idle rotating roller (26) acting as a counteracting means for an elongated workpiece to be submitted to a curling operation; said elongated workpiece being rotated by said mandrel (3), which is provided with a removable tool (4) for the curling operation.

3. A curling machine provided with an adjusting device for evenly winding elongated workpieces into spirals, comprising:

a machine frame (1) sustaining a worktable (2);

a mandrel (3) usable for a curling operation and passing through said worktable and being driven by a motor inside said frame; and counteracting means for acting on elongated workpieces and comprising an actuator (21) which is fixed on said worktable (2) and provided with a rod (23) carrying a tool holder (24) in the free end of the rod, said mandrel (3) being removable from the worktable (2).

4. Machine according to claim 3, wherein said tool holder (24) supports an idle rotating roller (26) that acts on an elongated workpiece to be submitted to a curling operation, the elongated workpiece being rotated by said mandrel (3), which is provided with a removable tool (4) for the curling operation.

5. Machine according to claim 3, wherein said actuator is immovably fixed on said worktable.

* * * * *